US005454568A

United States Patent [19]

Richardson

[11] Patent Number: 5,454,568

[45] Date of Patent: Oct. 3, 1995

[54] ONE WAY BREAKING GOLF SWING TRAINING CLUB

[76] Inventor: David G. Richardson, 33 Worthington Rd., Glastonbury, Conn. 06033

[21] Appl. No.: 182,588

[22] Filed: Jan. 18, 1994

[51] Int. Cl.[6] ..... A63B 69/36

[52] U.S. Cl. ..... 273/186.2; 273/193 B

[58] Field of Search ..... 273/193 R, 194 R, 273/186.1, 186.2, 187.4, 80 B, 80 R, 80.1, 80.2, 80 D, 167 G, 80 C, 77 R, 29 A, 164.1, 81.2, 81.3

[56] References Cited

U.S. PATENT DOCUMENTS

| | | | |
|---|---|---|---|
| 1,471,794 | 10/1923 | Leven | 273/186.2 |
| 1,524,196 | 1/1925 | Matthews . | |
| 1,529,305 | 3/1925 | Gatke | 273/186.2 |
| 1,990,281 | 2/1935 | Grelle | 273/186.2 |
| 2,005,915 | 6/1935 | Grelle | 273/186.2 |
| 2,158,211 | 5/1939 | Aitken . | |
| 2,159,579 | 5/1939 | Whitney . | |
| 2,223,647 | 12/1940 | Stumpf . | |
| 2,497,237 | 2/1950 | Reineking . | |
| 3,033,575 | 5/1962 | Hause | 273/193 B |
| 3,170,690 | 2/1965 | Goranson et al. . | |
| 3,229,980 | 1/1966 | Silberman . | |
| 3,606,340 | 9/1971 | Tiller . | |
| 3,679,205 | 7/1972 | Finkle | 273/186.2 |
| 3,698,720 | 10/1972 | Gudmundsen | 273/162 E |
| 4,118,033 | 10/1978 | Miyamoto . | |
| 4,479,653 | 10/1984 | Woolson . | |
| 4,854,585 | 8/1989 | Koch | 273/193 B |
| 4,856,782 | 8/1989 | Gannan | 273/193 B |
| 4,869,507 | 9/1989 | Sahm | 273/167 H |
| 4,872,683 | 10/1989 | Doran | 273/167 H |
| 4,889,343 | 12/1989 | Nielsen . | |
| 5,195,748 | 3/1993 | Koch | 273/193 B |
| 5,205,561 | 4/1993 | Lux | 273/193 B |

*Primary Examiner*—Sebastiano Passaniti

[57] ABSTRACT

A live-action golf swing training device provides the user with a proper take-away for his or her swing by using a one-way breaking joint which supports the alignment of the club on impact with a golf ball on the downswing portion of the stroke, but breaks the club if pulled away from the address too quickly even if the proper swing plane is used.

14 Claims, 4 Drawing Sheets

FIG. 1
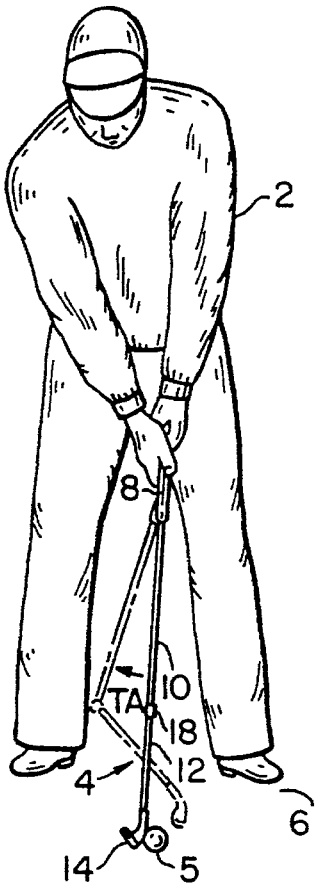
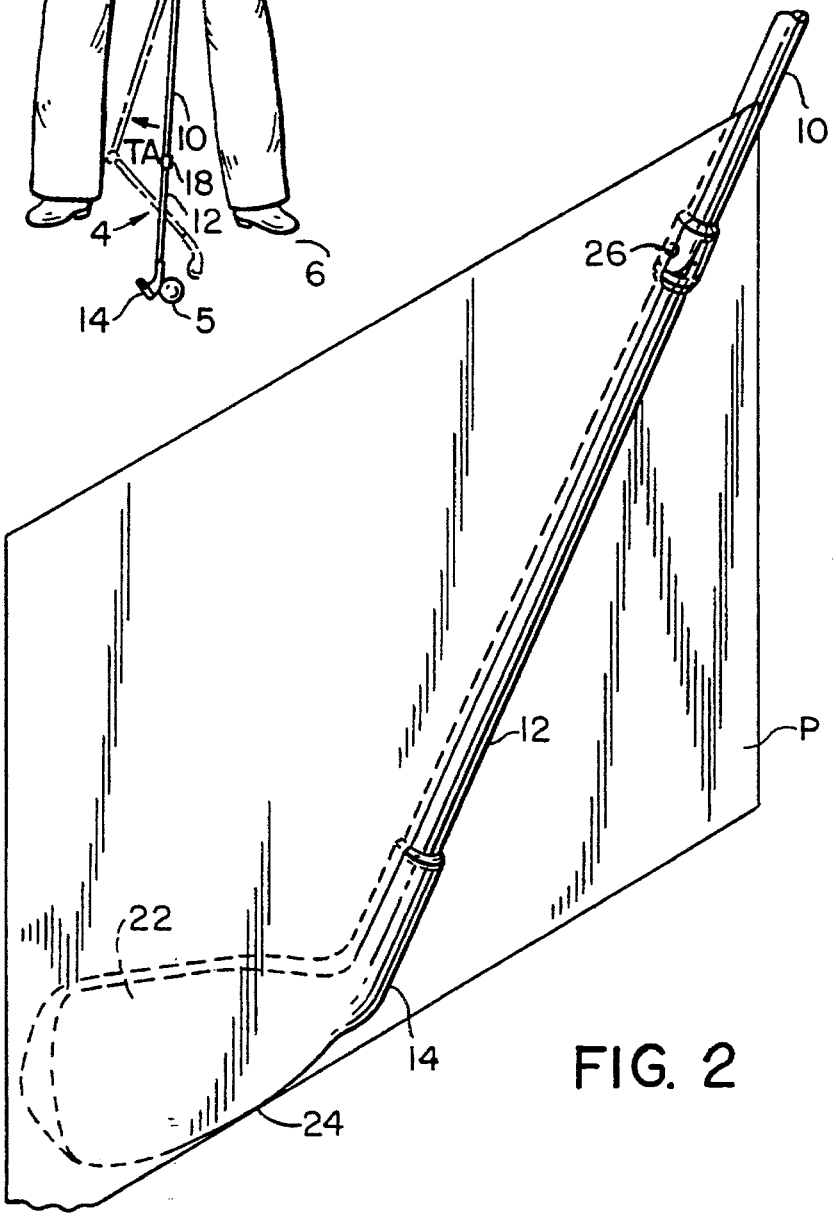
FIG. 2

ONE WAY BREAKING GOLF SWING TRAINING CLUB

The present invention relates to a training device for improving the golf swing of a user, and deals more particularly with a golf club adapted to be swung at a regulation ball so as to hit it and cause a proper shot to occur if the club is swung properly, but does not allow a swing to occur if the user's swing is not proper.

In golf, the proper swing begins with the set up and the golfer's address of the ball relative to his/her body position. A number of points usually are consciously taken into account by the golfer in setting up for the shot. The first is to gain an understanding of where the ball lies with respect to the ultimate target, be it a green, over a fairway bunker, or even a given target area on the fairway. Next, the gripping of the shaft of the club is done so that the arms and wrists actions of the swing can properly unlock the full potential of the body. Body motion is important to control the synchronization between the hands, arms and legs so that the club can swing through the ball. Key to swinging a correct golf shot is in the address of the ball and the return of the club head to this correct address on the downswing. In the address stage of the swing, if lines are drawn across the knees, hips, shoulders and head at the eyeline, they should all be parallel to the target line. Thus, the take away of the club head from the ball after such address has been made must be such that return of the club head to the ball is as close to the original address as possible. By the proper address of a ball, the golfer's knees are both in align with his or her shoulders, the weight is balanced equally and the grip created by the two hands form a V aiming toward the right shoulder. The take away thus must be as one piece as possible in order to keep this orientation of body parts. Ideally, the golfer pushes the club back with his left arm, in the case of a right handed player, allowing little if none hip turn so as to bring the bigger muscles into play. In this way, the gradual back swing of the golfer causes an almost complete 360 degree turn of the shoulders to get the club through the swing plane. The return stroke or the down stroke is where the power is created in the swing and starts from the apex of the take away or back swing. At the transition between the back swing to the downswing, forward motion is imparted to the club to accelerate it through the ball. In two-way golf swing training devices, such as disclosed in U.S. Pat. No. 4,854,585, this transition will often cause undesirable collapsing of the club at a point where the applied load may very well be acceptable. While in some cases breakage at this point is a valid indication of an improper swing, for the most part though, the effect is minimum taken relative to the more significant effect of obtaining greater club speed from the beginning of the down stroke. Also, the mechanism for breaking a club when a user makes a swing which is proper must be sufficiently strong to withstand the impact forces which may be transmitted through the shaft on impacting with the ball, the ground or both. As well, the joint must be compact and be significantly rigid in order to maintain the appropriate aligned orientation of the handle of the club relative to the orientation of the club face.

Accordingly is the objection of the invention to provide a golf swing training device in the form of a club having a break away shaft which is suited for breaking only in one direction upon the improper back swing resulting from unwanted wrist action or other jerking actions from an addressed position of the club head to the peak of the back swing.

It is yet a further objection of the invention to provide within a golf club of the aforementioned type, a hinge which is suitably fashioned for compact fixture within the hollow shaft of a golf club and having sufficient strength to withstand loads imparted to it upon impacting on the golf ball or other stationary objections, such as harden turf or cement based practice tees.

Accordingly it is still further an objection of the invention to provide a golf training device of the aforementioned type wherein the sensitivity of the breaking joint can be set according to a given predetermined skill level for the golfer who will use it.

SUMMARY OF THE INVENTION

A one way breaking golf club training device of the type wherein the head of the club is normally in alignment with the remaining shaft portion until improperly swung by the golfer allows live-action golf practice swings to be effected when a proper golf take away is practiced by the user. To these ends, the club is comprised of a first shaft portion and a second shaft portion, the first shaft portion being associated with a gripping end of the club and a the second shaft portion being associated with a club head end of the club, and the first and second shaft portions being connected to one another intermediate the length of the club by a breaking joint means. The breaking joint means is a compact two-part device which includes a bifurcated part and a tongue part each respectively associated with one of the first and second shaft portions of the club and pivotally connected for angular movement in a single direction by a transversely extending pivot pin journalled within the bifurcated part of the breaking joint means. To achieve the one way breaking action while still allowing the club first and second shaft portions to be aligned with one another, a detent means is provided as part of the breaking joint means for maintaining the first and .second shaft portions in alignment with one another, yet allowing pivoting motion in a single angular direction to occur. To arrest relative rotational movement in the other rotational direction, the breaking joint means further includes an abutment face means interposed between the bifurcated and tongue parts for prohibiting rotational movement of the bifurcated and tongue parts in a direction opposite of the one direction.

BRIEF DESCRIPTION OF THE DRAWINGS

FIG. 1 is a side elevation view shown in perspective of a golfer and the golf training device shown in its breaking mode in phantom line.

FIG. 2 is a partially fragmentary perspective view showing the relationship between the club face leading edge and the shaft breaking mechanism.

DETAILED DESCRIPTION OF THE PREFERRED EMBODIMENT

Figure 3:
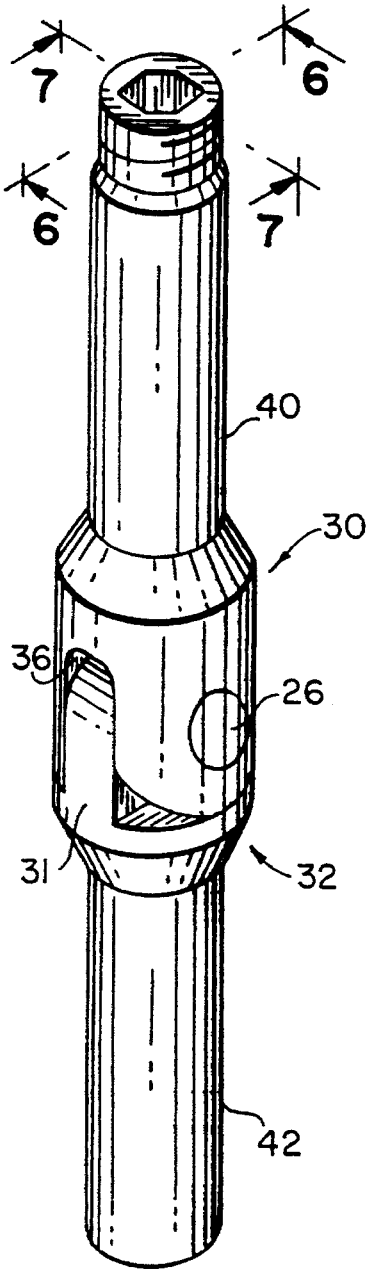
FIG. 3 is a perspective view showing the hinge mechanism apart from the golf club which it is used.

FIG. 1 illustrates a golfer 2 shown in the address position of a golf swing, gripping a training club 4 of the present invention shown as a long iron. In this address position of the illustrated example, the golfer is aligned with the ball 6 such that the club rests on the fairway or range 6 and impacts on the ball 5 upon the return of the club from its back swing. The training club 4, includes a handle portion 8, a first upper shaft 10 on which the handle portion 8 is attached by bonding, a second shaft 12 to which a club head 14 is secured, the first and second shaft portions being releasably hingedly interconnected with one another through the intermediary of a breaking joint means 18 disposed between the juxtaposed confronting ends of the first and second shafts. The lengths of the shafts 10 and 12 vary based on the size of the golfer, but the length of the second shaft is preferably substantially less than that of the first portion on the order, for example, of about three to four times in the case of a long iron.

As illustrated in FIG. 1, the golfer, from this initial addressing of the ball, which is effected by the preliminary checks that are made by the golfer in his or her initial set up, i.e., noting for example the target line, the orientation of feet, hands, eyes, and shoulders relative to the target line, secures a viable position from which to begin a shot. In this position, the first and second shafts 10 and 12 are together in alignment as would be the case if a normal club was being used. With this in mind, the training swing is then commenced by the golfer's taking away of the club head 14 from the ball 5 in the direction illustrated by arrow TA as if the club used were one of a one piece shaft construction. If the golfer in taking the club head 14 back from its initial address, does this in accordance with the correct moves, then take away of the club will occur without breaking at the breaking joint means 18. But, in the event that such take away movement is accomplished improperly, i.e., imparting by the golfer a jerking movement when taking the club head away, or using excessive wrist action in the take away, or even pulling up of one's head, the training club 4 will break at the breaking joint means 18 in the manner illustrated in phantom line depiction of the club in FIG. 1.

As seen in FIG. 2, the club head 14 is generally a wedged shaped member as seen in side elevation view having a frontal club face 22 which at its lower end is defined by a leading edge 24 and from which leading edge the club face 22 extends upwardly at an angle to effect a given trajectory on the ball in the case of woods and irons, but is otherwise vertically extending in the case of the a putter. The angular orientation of the leading edge 24 of the club head 14 relative to the body orientation of the golfer 2 will define the type of hit that will be imparted to the golf ball 5. That is, if the edge 24 is oriented such that the club face 22 during a stroke moves across the ball in a right to left manner, then a slice will occur, and if the opposite is true where the leading edge is oriented such that the club face 22 moves from left to right across the ball then a hook is likely to occur, speaking strictly from the point of view of a right hand golfer.

The orientation of the breaking joint means 18 relative to the leading edge 24 of the club head is important to the breaking effect of the club 4. For purposes of this discussion, and as will become more readily apparent with respect to the mechanism of the joint means 18, it should be seen that this means includes a transverse pin means 26 which is journalled within the breaking joint means 18 and is responsible for the relative angular movements occurring therebetween. This relationship is best illustrated in FIG. 2 wherein the leading edge 24 of the club face 22 and the transverse pin means 26 are disposed coincidentally with one another in a common plane P. This orientation is important in that it allows for pivoting of the club head even if the club is swung in the correct plane, but is jerked back or is otherwise caused to accelerate faster than what would be prescribed for a proper golf swing.

Figure 4:
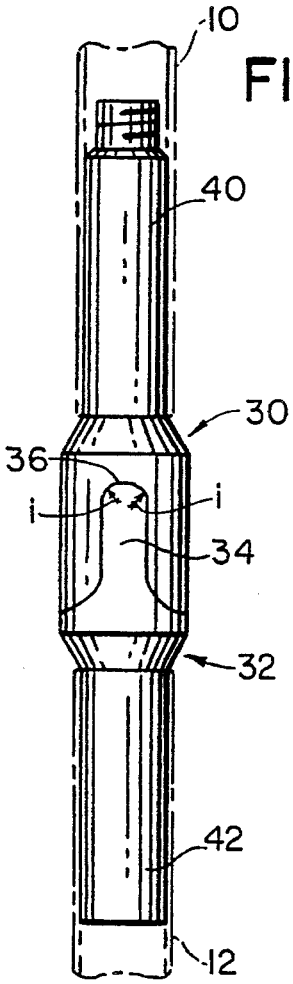
FIG. 4 is a partially fragmentary side elevation view showing the breaking mechanism of FIG. 3 as it exists fixed within the shaft of the golf club shown in phantom line.

Referring now to FIGS. 3–7, and in particular to the details of the breaking joint means 18, it should be seen that the breaking joint means 18 in addition to the transversely extending pin means 26, includes a bifurcated first part 30 and a tongue second part 32 having a tongue portion 34, the bifurcated first part 30 having a clevis 36 complimentarily sized and shaped to receive the tongue portion 34 of the tongue second part 32. As illustrated in FIG. 4, each of the bifurcated first part 30 and the tongue second part 32 has a cylindrical body portion 40 and 42 respectively integrally connected with it and disposed about a central axis C. The body portions are cylindrical in shape which allow them to be inserted within the like cylindrical interiors of the first and second shaft members 10 and 12. In actuality, the outer diameter of each of the body portions 40 and 42 is slightly somewhat larger than the inner diameter of the first and second shaft members 10 and 12, such that assemblage of the body portions 40 and 42 with each of the shaft portions 10 and 12 is accomplished by the heating of the shaft ends followed by the insertion of the cylindrically shaped body portions into the now expanded shafts with a heat sensitive epoxy applied to the outer surfaces of the body portions 40 and 42 and then allowing the epoxy to harden in situ with the shrinkage of metal shaft as known in the industry.

Figure 6:
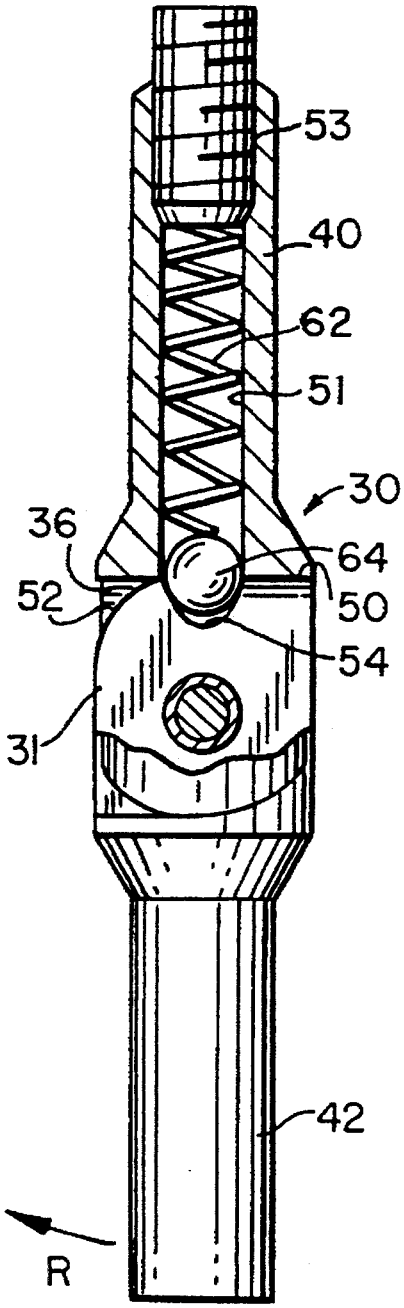
FIG. 6 is a partially fragmentary vertical view taken along line 6—6 in FIG. 3.
Figure 7:
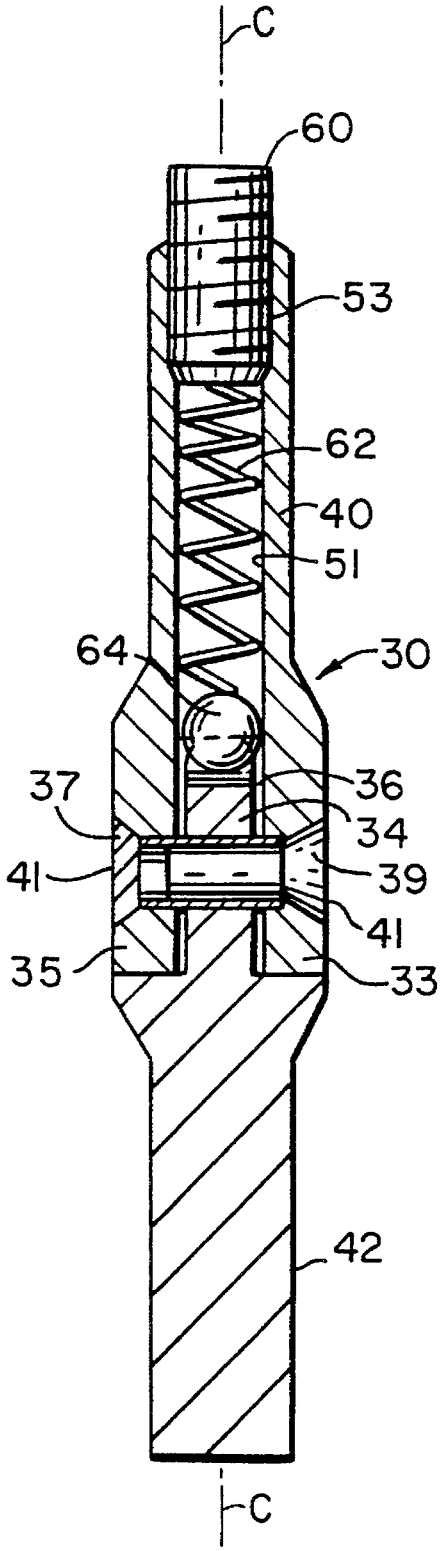
FIG. 7 is a vertical sectional view taken along line 7—7 in FIG. 3.

As best illustrated in FIGS. 6 and 7, the tongue 34 of the part 32 is interdigitated within the clevis 36 of the second part 30 and the two arms 33 and 35 which define the clevis 36 along with the tongue 34, each has a through opening formed in it coaligned with one another so as to journal the pin means 26 within the arms 33, 35 and provide a bearing about which the tongue portion 34 is made to rotate in the illustrated direction R. In the illustrated embodiment, the pin means 26 is of a two-part construction as defined by a telescopically receiving first pin part 37 providing the bearing surface along which the tongue portion 34 moves, and as solid second pin part 39 received by the first pin part and held in place by an interference fit or other the like securement. These pin parts each have frustoconical head portions which are complementarily sized and shaped so as to be received within like shaped openings formed in the side surfaces of the arms 33 and 35.

Figure 5:
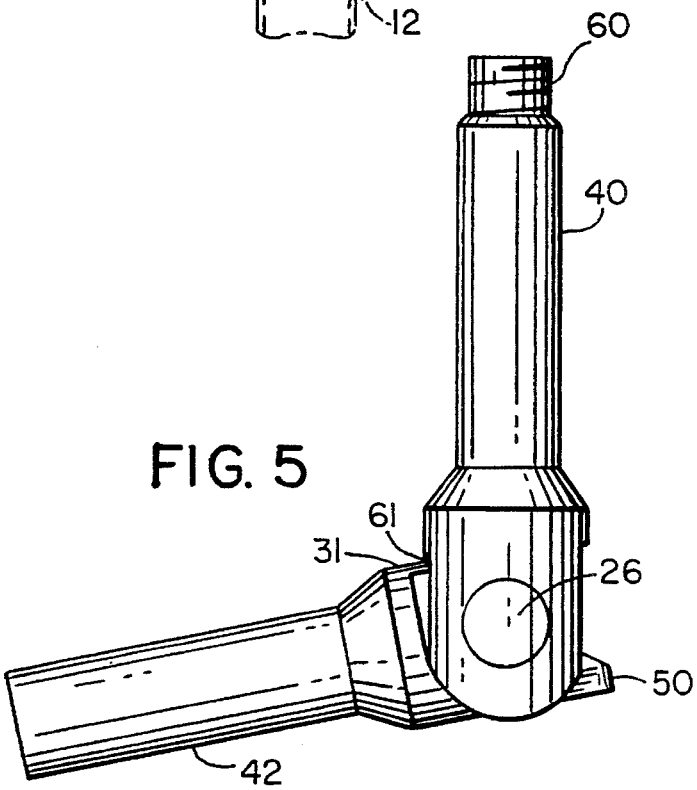
FIG. 5 illustrates in side view the breaking mechanism of FIG. 2 in its broken condition.
Figure 8:
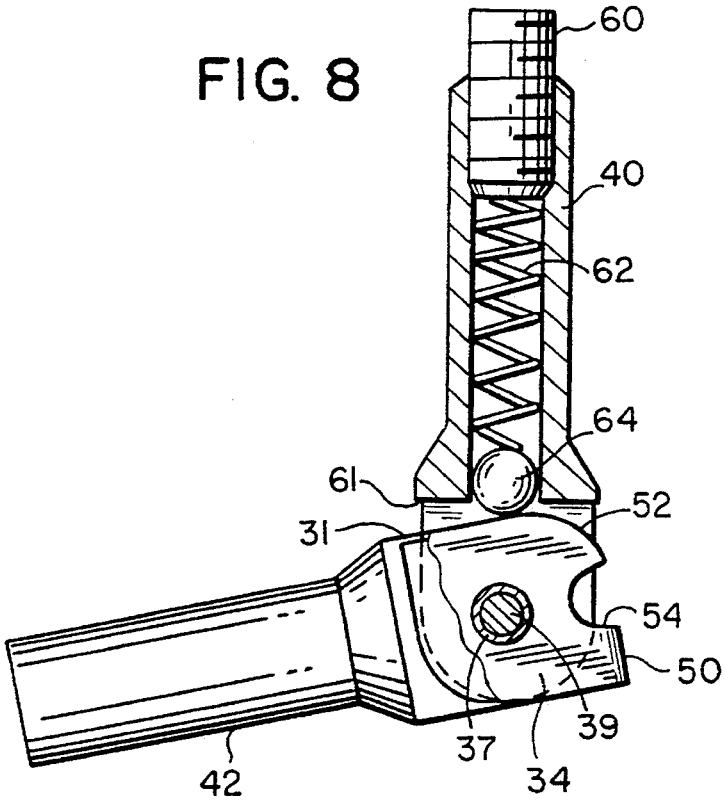
FIG. 8 is a partially fragmentary view of the breaking mechanism shown in the broken condition of FIG. 5.

To effect abutment as well as relative rotation between the tongue part 32 and the bifurcated part 30, the tongue 34 of the part 32 as seen in FIG. 6, is provided with a generally bow-like profile as defined by a generally straight frontal abutment edge portion 50 associated with the trailing side of the club head contiguously interconnected with curved portion 52 associated with the club face side of the club head, each of these portions being separated from one another by an arcuate cut-out 54 disposed therebetween. Formed through the body portion 40 of the bifurcated part 30 is a through opening 51 extending coaxiallly with the central axis C and opening to the clevis 36. The opening 51 at its top end, is threaded at 53 so as to threadedly receive a set screw 60 therein. A helical compression spring 62 is also provided within the opening 51 and acts at its top end against the set screw 60 and acts at its lower end against a spherical member 64 sized so as to also be received within the opening 51 and within the cut-out 54 formed in the tongue portion 34. The size and shape of the cut-out is however selected so as to receive in part only a portion of a spherical member 56, i.e., up to but not including one half of this shape, so as to locate it part way within the opening 51 of the bifurcated part 30 and part way within the cut-out 54 when the first and second shaft members are in alignment with one another. By presetting the set screw within the opening 51 at a given depth, the force exerted by the compression spring 62 on the spherical member can be varied according to the skill level of the user. The type and material selected for the spring 62 may vary, but in the preferred embodiment, it is formed from music wire with a wire diameter equaling 0.035 inch and has 16 active coils defining a coil diameter of about 0.175 inch. As such, if an unacceptable amount of take away force is applied to the breaking joint means 18, the spherical member 64 will be caused to ramp up out of the curved surface configuration of the cut-out 54 and thereafter be caused to bear down upon the curved surface portion 52 of the tongue potion 34, until the leading side face 31 of the tongue part 34 and the inner transverse surface 61 of the clevis 36 abut one another to effect stoppage of the breaking action in the club as best illustrated in FIGS. 5 and 8.

The generally straight abutment edge portion of the 50 of the tongue portion 34 defines a single line in side view along a surface which as seen in FIG. 4 is curved to create stress reduction areas which coact with like shaped areas formed in the clevis 36 on which are brought to bear the forces acting through the first and second shaft members 10 and 12, which forces can be the result of the acceleration on the downswing of the club from the apex of a swing or, even the impacting force imparted on the club head 14. To this end, as seen in FIG. 4, the tongue portion 34 at its upper end may be slightly curved about its edges at radii i,i which are likewise formed in the clevis 36 of the bifurcated part 30 to create complimentary engaging surfaces. Additionally the material selected for the tongue part 32 and the bifurcated part 30 is highly ductile to further assist in the reduction of stress propagation, and in the preferred embodiment, is a tempered steel heat treated to a final hardness of 45 to 48 Rc.

Figure 9:
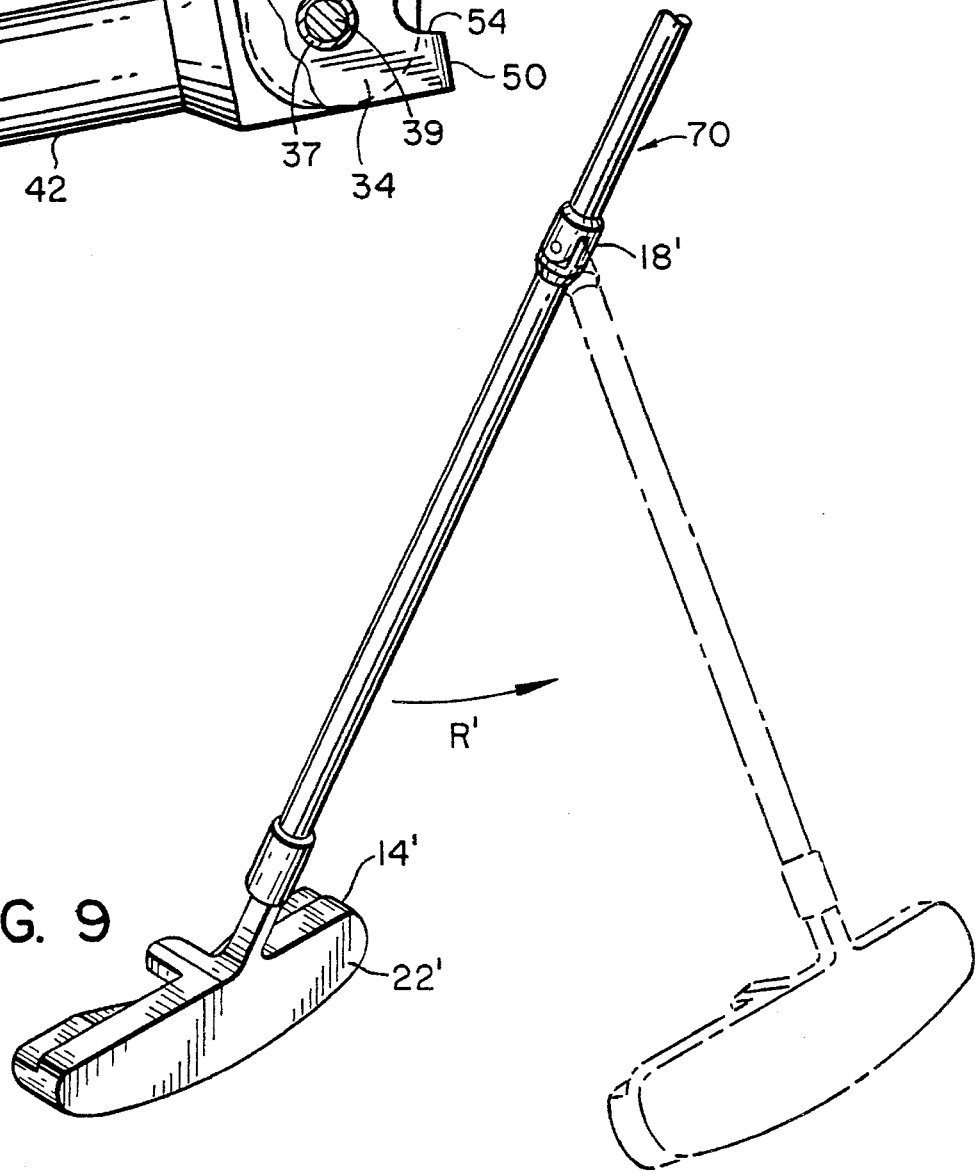
FIG. 9 is a perspective view showing the hinge mechanism as part of a putter.

By the foregoing, an improved golf swing training device has been disclosed by way of illustration rather than limitation. However numerous substitutions and modifications can be had without departing from the spirit of the invention. For example, the breaking device may be used in other clubs, and not necessarily with the hard swinging action found with drivers or irons. But rather, the joint may be employed in a putter 70, as shown in FIG. 9, to gain better motion control in a putting stroke. As illustrated in FIG. 9, the breaking joint means 18' used in a putter type club such that the pin 26' extends parallel to the putting face 22' of the putter. The breaking joint means 18' is otherwise identical to that which is discussed with reference to FIGS. 3–8, allowing relative pivoting in the direction R', except that tension on the spring is probably less given the different loading characteristics created by the putter head.

I claim:

1. A golf swing training device comprising;

a first shaft member and a second shaft member, the first shaft member associated with a gripping end of the club and the second shaft member being associated with a club head end of the club;

said club head having a lower leading edge which defines upwardly therefrom a club hitting face:

said first and second shaft members being connected intermediate the length of said club by a breaking joint means;

said breaking joint means including a pivot means, a bifurcated part and a tongue part each respectively associated with one of said first and second shaft members and interconnected with one another by said pivot means;

said breaking joint means including a detent means for releasably maintaining said first and second shaft members in alignment with one another, but allowing pivoting motion to occur in one angular direction;

said breaking joint means further including an abutment face means interposed between said bifurcated part and said tongue part for arresting rotational movement of said bifurcated and tongue parts in a direction opposite that of said one angular direction; and wherein said breaking joint means is connected to each of said first and second shaft members such that the pivot means of said breaking joint means and the leading edge of said club face lie substantially in the same plane with one another.

2. A device as defined in claim 1 further characterized in that each of said tongue part and said bifurcated part has an integrally formed body portion adapted to be received within each of said first and second shaft members.

3. A device as defined in claim 2 further characterized in that said tongue part includes a tongue portion defined by a bow-like profile having a straight leading edge profile and a curved edge profile with an arcuate cut-out disposed intermediate therebetween, the cut-out of said tongue portion being sized to partially receive a spherical member housed within the body portion of said bifurcated member.

4. A device as defined in claim 3 further characterized by said spherical member being biased toward said tongue portion by a spring member interposed within said body part of said bifurcated part.

5. A device as defined in claim 4 further characterized in that said tongue portion having curved portions along its side edges and communicating with said straight edge profile of said tongue portion so as to be complementarily arcuately shaped to be received within an arcuately shaped clevis formed by said bifurcated part.

6. A device as defined in claim 5 further characterized in that said bifurcated part includes two spaced apart arms defining a clevis and said tongue portion and each of said arms having co-aligned openings formed therein for receiving a pivot pin;

wherein said pivot pin is part of said pivot means and is of a two-part construction.

7. A device as defined in claim 6 further characterized in that said bifurcated part and said tongue part are formed from-tempered steel heat treated to a final hardness of 45 to 48 Rc.

8. A device as defined in claim 4 further characterized in that said bifurcated member includes a through opening formed co-axially through said body portion in which said spring member is received and said opening at a top end of said spring member is threaded to receive a set screw against which the top end of the spring member abuts such that a bottom end of said spring member engages with the spherical member.

9. A device as defined in claim 8 further characterized in that the size and shape of the cut-out is selected so as to receive in part only a portion of said spherical member such that said spherical member is located part way within the opening formed in the bifurcated part and part way within the cut-out when the first and second shaft members are in alignment with one another.

10. A device as defined in claim 1 further characterized in that said club head is an iron.

11. A device as defined in claim 1 further characterized in that said club head is a wood.

12. A device as defined in claim 1 further characterized in that said club head is a putter.

13. A golf swing training device comprising;

a first shaft member and a second shaft member, the first shaft member associated with a gripping end of the club and a the second shaft member being associated with a club head end of the club;

said first and second shaft members being connected intermediate the length of said club by a breaking joint means;

said breaking joint means including a pivot means, a bifurcated part and a tongue part each respectively associated with one of said first and second shaft members and interconnected with one another by said pivot means;

said breaking joint means including a detent means for releasably maintaining said first and second shaft members in alignment with one another, but allowing pivoting motion to occur in one angular direction;

said breaking joint means further including an abutment face means interposed between said bifurcated part and said tongue part for arresting rotational movement of said bifurcated and tongue parts in a direction opposite that of said one angular direction; and wherein said bifurcated member and said tongue member are formed from tempered steel heat treated to a final hardness of 45 to 48 Rc.

14. A golf swing training device comprising;

a first shaft member and a second shaft member, the first shaft member associated with a gripping end of the club and the second shaft member being associated with a club head end of the club;

said club head having a lower leading edge which defines upwardly therefrom a club hitting face:

said first and second shaft members being connected intermediate the length of said club by a breaking joint means;

said breaking joint means including a pivot means, a bifurcated part and a tongue part each respectively associated with one of said first and second shaft members and interconnected with one another by said pivot means;

said breaking joint means including a detent means for releasably maintaining said first and second shaft members in alignment with one another, but allowing pivoting motion to occur in one angular direction;

said breaking joint means further including an abutment face means interposed between said bifurcated part and said tongue part for arresting rotational movement of said bifurcated and tongue parts in a direction opposite that of said one angular direction;

said breaking joint means being connected to each of said first and second shaft members such that the pivot means of said breaking joint means and the leading edge of said club face lie substantially in the same plane with one another; and said tongue part having opposed curved portions along its side edges adjacent the free end thereof so as to be complementarily arcuately shaped to be received within an arcuately shaped clevis formed by said bifurcated part.

* * * * *